US008599182B2

(12) United States Patent
Chang

(10) Patent No.: US 8,599,182 B2
(45) Date of Patent: Dec. 3, 2013

(54) POWER SEQUENCE CONTROL CIRCUIT, AND GATE DRIVER AND LCD PANEL HAVING THE SAME

(75) Inventor: Chih-Yuan Chang, Changhua County (TW)

(73) Assignee: Novatek Microelectronics Corp., Hsinchu (TW)

( * ) Notice: Subject to any disclaimer, the term of this patent is extended or adjusted under 35 U.S.C. 154(b) by 963 days.

(21) Appl. No.: 12/177,166

(22) Filed: Jul. 22, 2008

(65) Prior Publication Data

US 2009/0278590 A1 Nov. 12, 2009

(30) Foreign Application Priority Data

May 8, 2008 (TW) ..... 97116995 A

(51) Int. Cl.
*G09G 5/00* (2006.01)

(52) U.S. Cl.
USPC ..... 345/211; 345/95

(58) Field of Classification Search
USPC ..... 345/211, 87, 95; 327/434
See application file for complete search history.

(56) References Cited

U.S. PATENT DOCUMENTS

| | | | | |
|---|---|---|---|---|
| 5,760,759 | A | 6/1998 | Tanaka et al. | |
| 6,219,016 | B1 | 4/2001 | Lee | |
| 6,225,838 | B1 * | 5/2001 | Lee | 327/108 |
| 6,249,145 | B1 * | 6/2001 | Tanaka et al. | 326/68 |
| 6,351,360 | B1 * | 2/2002 | Kotowski et al. | 361/103 |
| 6,373,479 | B1 | 4/2002 | Moon | |
| 6,407,898 | B1 | 6/2002 | Wu | |
| 6,542,144 | B2 * | 4/2003 | Kogure et al. | 345/98 |
| 6,839,211 | B2 | 1/2005 | Ajit | |
| 6,940,334 | B2 | 9/2005 | Ajit | |
| 7,015,904 | B2 | 3/2006 | Kim | |
| 2004/0239655 | A1 * | 12/2004 | Tani et al. | 345/204 |

FOREIGN PATENT DOCUMENTS

TW I282961 6/2007

OTHER PUBLICATIONS

"Office Action of Taiwan Counterpart Application", issued on Nov. 20, 2012, p. 1-p. 12.

* cited by examiner

*Primary Examiner* — Chanh Nguyen
*Assistant Examiner* — John Kirkpatrick
(74) *Attorney, Agent, or Firm* — Jianq Chyun IP Office

(57) ABSTRACT

A power sequence control circuit receives an input positive voltage and an input negative voltage. The control circuit includes a pull-up stage, having a first terminal receiving the input positive voltage, a second terminal coupled to a node, and a control terminal receiving feedback of an output positive voltage. A pull-down stage has a first terminal coupled to the node and a second terminal coupled to an output negative voltage. A current-limit switching unit has a first terminal receiving the input positive voltage, a second terminal outputting the output positive voltage, and a control terminal coupled to the node. When the output negative voltage decreases, and if the pull-down stage decreases a control voltage at the node and the control voltage is less than a threshold value, the current-limit switching unit is conducted to transmit the input positive voltage as the output positive voltage.

30 Claims, 6 Drawing Sheets

POWER SEQUENCE CONTROL CIRCUIT, AND GATE DRIVER AND LCD PANEL HAVING THE SAME

CROSS-REFERENCE TO RELATED APPLICATION

This application claims the priority benefit of Taiwan application serial no. 97116995, filed May 8, 2008. The entirety of the above-mentioned patent application is hereby incorporated by reference herein and made a part of this specification

BACKGROUND OF THE INVENTION

1. Field of the Invention

The present invention generally relates to a gate driver of a liquid crystal display (LCD) panel, and more particularly to a gate driver having a power sequence control circuit.

2. Description of Related Art

In a typical driving system of a conventional LCD, it is desired to apply voltages in a proper sequence. Otherwise, it may cause unusual displaying, or even damages. For example, when applying a gate high voltage VGH and a gate low voltage VGL to a gate driver, an error of sequence in enabling these two voltages may cause a failure in operation of the circuit, e.g., latch-up, and even a damage to the integrate circuit (IC). The gate high voltage VGH and the gate low voltage VGL are an operation positive voltage and an operation negative voltage respectively, which are usually provided by a power block and transmitted to the gate driver. If the VGH signal enters the gate driver earlier than the VGL signal or the two voltages simultaneously enter the gate driver, a transient current may occur. Because generally the VGL voltage is usually coupled to the substrate, when the transient current flows to the substrate, the VGL voltage will be pulled up. When the VGL voltage becomes greater than 0.5 to 0.7V because of pull up effect, a latch-up phenomenon will occur, or a large current may be generated and thus damaging the IC.

In order to avoid the foregoing problems, e.g., damaging the IC, the VGL signal is desired to enter the gate driver earlier than the VGH signal. Generally, the power block provides a gate high voltage VGHp, and a gate low voltage VGLp, in which "p" means that the voltage (VGHp or VGLp) is outputted from the power block and has not yet been entered into the gate driver. Before the VGHp and VGLp enter the gate driver, a sequence of providing the power must be adjusted by external elements or a timing controller, so as to have VGLg entering the gate driver earlier than VGHg, in which "g" means that the voltage (VGHg or VGLg) is actually inputted to the gate driver.

FIG. 1 is a schematic diagram illustrating a general structure of a conventional LCD device. Referring to FIG. 1, a timing controller 100 is a core block provided for controlling an action timing of the display. The timing controller 100 determines horizontal scanning enabling, and converts video signals inputted from an interface into data signals usable for a source driver 102, e.g., RGB data, according to a display timing of each frame. The data signals are transmitted to a memory of the source driver 102, and are cooperated with the horizontal scanning to control the gate driver 102 with a proper timing.

A power block 110 is provided with an external power source VDD. Controlled by the timing controller 100, the power block 110 generates a plurality of voltage levels, and provides these voltage levels to the timing controller 100, the source driver 102, and the gate driver 104. Controlled by the timing controller 100, the source driver 102 stores digital video signals inputted with a high frequency into the memory, and converts the digital video signals into voltages desired to output to a sub-pixel 108, according to an enabling of a particular scan line, so as to drive data lines S1, . . . , Sn of the pixel display panel 106.

Controlled by the timing controller 100, the gate driver 104 sequentially outputs suitable ON/OFF voltages to particular scan lines G1 through Gn, for driving the scan lines of the pixel display panel 106. The pixel display panel 106 is constituted of a plurality of pixels, where each pixel comprises a red sub-pixel, a green sub-pixel, and a blue sub-pixel. Each sub-pixel includes a thin film transistor (TFT) having a gate terminal which is controlled by a scan driving circuit for controlling the ON/OFF status of the TFT. When the TFT is at an ON status, a source terminal of the TFT charges a capacitor of the TFT to a voltage level corresponding to the received data. A twist angle of liquid crystal molecules is determined according to the voltage level, and therefore the grey level of the image performance while the liquid crystal molecules are illuminated by a backlight can be determined. Color filters then combine sub-pixels of different grey levels on the display panel to obtain desired colors, which constitute a high resolution image.

As discussed above, if the voltage signals VGHp, VGLp provided by the power block 110 are directly inputted into the gate driver 104, it cannot be assured that the VGLp signal will be inputted earlier than the VGHp. As such, conventionally, an external circuit 112 is employed to control the sequence of inputting the voltages, so as to properly provide the VGHg, VGLg to the gate driver 104.

Conventionally, there are many approaches to change the sequence of providing power sources. FIG. 2 is a schematic diagram illustrating a conventional mechanism for changing the sequence of providing power sources. Referring to FIG. 2, it illustrates a conventional RC delay method, in which the VGHp signal provided by the power block 110 is delayed and enters the gate driver 104 later than the VGLp signal. As shown in the upper part of FIG. 2, the VGHp signal is delayed by a delay time T, thus entering the gate driver 104 later than the VGLp signal. This approach is simple while having its disadvantages. For example, the delay time is determined by a value of R×C. However, it is often not appropriate to integrate the resistor R and the capacitor C inside the IC, because they occupy area and increase production cost. Even though it can be achieved by external components, the external components also increase the production cost. Further, an external capacitor usually has a large capacitance, and therefore when turning off the power, the large capacitance may cause the VGHg voltage unable to discharge very quickly. Further, in this case, when the power is turned on again, the circuit may be damaged.

Further, another approach is to employ a timing controller to control the sequence of the VGH signal and the VGL signal entering the gate driver. However, this requires an external resistor and capacitor, or an external timing control signal for controlling the sequence of the VGH signal and the VGL signal, which increase the complexity and the production cost.

SUMMARY OF THE INVENTION

Accordingly, the present invention is directed to power sequence control circuit of a gate driving technology, which is adapted for effectively controlling a sequence of power signals entering a gate driver.

The present invention provides a power sequence control circuit, receiving an input positive voltage and an input negative voltage, for providing an output positive voltage and an output negative voltage to the gate driver. The power sequence control circuit includes a voltage pull-up stage, a voltage pull-down stage, and a current limit switching unit. The voltage pull-up stage includes a first terminal coupled to the input positive voltage, a second terminal coupled to a node, and a control terminal receiving a feedback of the output positive voltage. The voltage pull-down stage includes a first terminal coupled to the node, and a second terminal coupled to the output negative voltage. The current limit switching unit includes a first terminal receiving the input positive voltage, a second terminal outputting the output positive voltage, and a control terminal coupled to the node. When the output negative voltage decreases, the voltage pull-down stage pulls down a control voltage corresponding to the node, and when the control voltage is lower than an enabling threshold, the current limit switching unit conducts to transmit the input positive voltage as the output positive voltage.

The present invention further provides a gate driver, for driving an LCD panel. The gate driver includes a gate driving circuit, for driving the LCD panel, and a power sequence control circuit, receiving an input positive voltage and an input negative voltage, for providing an output positive voltage and an output negative voltage to the gate driver. The power sequence control circuit includes a voltage pull-up stage, a voltage pull-down stage, and a current limit switching unit. The voltage pull-up stage includes a first terminal coupled to the input positive voltage, a second terminal coupled to a node, and a control terminal receiving a feedback of the output positive voltage. The voltage pull-down stage includes a first terminal coupled to the node, and a second terminal coupled to the output negative voltage. The current limit switching unit includes a first terminal receiving the input positive voltage, a second terminal outputting the output positive voltage, and a control terminal coupled to the node. When the output negative voltage decreases, the voltage pull-down stage pulls down a control voltage corresponding to the node, and when the control voltage is lower than an enabling threshold, the current limit switching unit conducts to transmit the input positive voltage as the output positive voltage.

The present invention further provides an LCD panel. The LCD panel includes a pixel display unit, a source driver, a gate driver, a power unit, a power sequence control circuit, and a timing controller. The pixel display unit includes a plurality of pixels. The source driver and the gate driver drive the pixels for displaying. The power unit provides an operation positive voltage and an operation negative voltage. The power sequence control circuit receives the operation positive voltage and the operation negative voltage for serving as an input positive voltage and an input negative voltage, and outputs the operation positive voltage and the operation negative voltage to the gate driver for serving as an output positive voltage and an output negative voltage. The power sequence control circuit includes a voltage pull-up stage and a voltage pull-down stage, a current limit switching unit. The voltage pull-up stage includes a first terminal, a second terminal, and a control terminal. The first terminal of the voltage pull-up stage is coupled to the input positive voltage. The second terminal of the voltage pull-up stage is coupled to a node. The control terminal of the voltage pull-up stage is adapted for receiving a feedback of the output positive voltage. The voltage pull-down stage includes a first terminal, and a second terminal. The first terminal of the voltage pull-down stage is coupled to the node. The second terminal of the voltage pull-down stage is coupled to the output negative voltage. The current limit switching unit includes a first terminal receiving the input positive voltage, a second terminal outputting the output positive voltage, and a control terminal coupled to the node. When the output negative voltage decreases, the voltage pull-down unit pulls down a control voltage corresponding to the node, and when the control voltage is lower than an enabling threshold, the current limit switching unit conducts to transmit the input positive voltage as the output positive voltage.

According to an embodiment of the present invention, the voltage pull-down stage of the power sequence control circuit is a resistor coupled between the first terminal and the second terminal of the voltage pull-down stage.

According to an embodiment of the present invention, the voltage pull-up stage of the power sequence control circuit includes a first path including at least one PMOS transistor serially coupled between the first terminal and the second terminal of the voltage pull-up stage, and a gate of the PMOS transistor is coupled to the control terminal of the voltage pull-up stage.

According to an embodiment of the present invention, the voltage pull-up stage of the power sequence control circuit further includes a second path having a same configuration of the first path and being parallel coupled with the first path.

According to an embodiment of the present invention, the voltage pull-down stage of the power sequence control circuit includes a first path including at least one NMOS transistor, serially coupled between the first terminal and the second terminal of the voltage pull-down stage, a gate of the NMOS transistor being coupled to a system voltage.

According to an embodiment of the present invention, the voltage pull-down stage of the power sequence control circuit further includes a second path having a same configuration of the first path and parallel coupled with the first path.

According to an embodiment of the present invention, the first path of the voltage pull-down stage of the power sequence control circuit further includes at least one diode connector serially coupled to the NMOS transistor.

According to an embodiment of the present invention, the current limit switching unit of the power sequence control circuit includes a first path including at least one PMOS transistor, serially coupled between the first terminal and the second terminal of the current limit switching unit, a gate of the PMOS transistor being coupled to the control terminal of the current limit switching unit.

According to an embodiment of the present invention, the current limit switching unit of the power sequence control circuit further includes a second path having a same configuration of the first path and parallel coupled with the first path.

According to an embodiment of the present invention, the current limit switching unit of the power sequence control circuit includes a first path including at least one BJT transistor, serially coupled between the first terminal and the second terminal of the current limit switching unit, a base electrode of the BJT transistor being coupled to the control terminal of the current limit switching unit.

According to an embodiment of the present invention, the current limit switching unit of the power sequence control circuit further includes a second path having a same configuration of the first path and parallel coupled with the first path.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
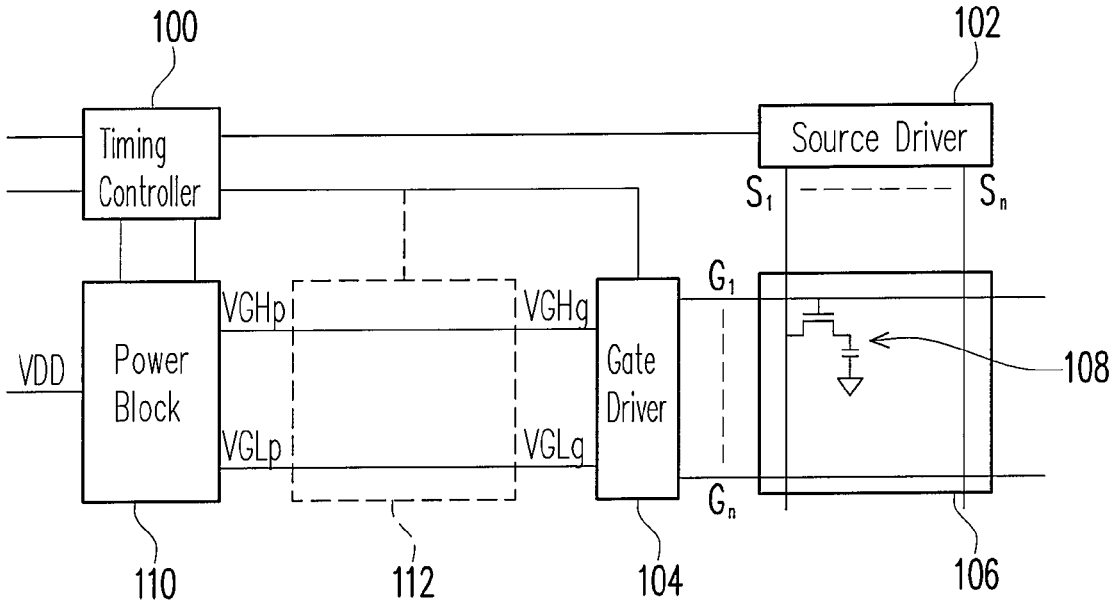
FIG. 1 (PRIOR ART)
FIG. 1 is a schematic diagram illustrating a general structure of a conventional LCD panel.
Figure 2:
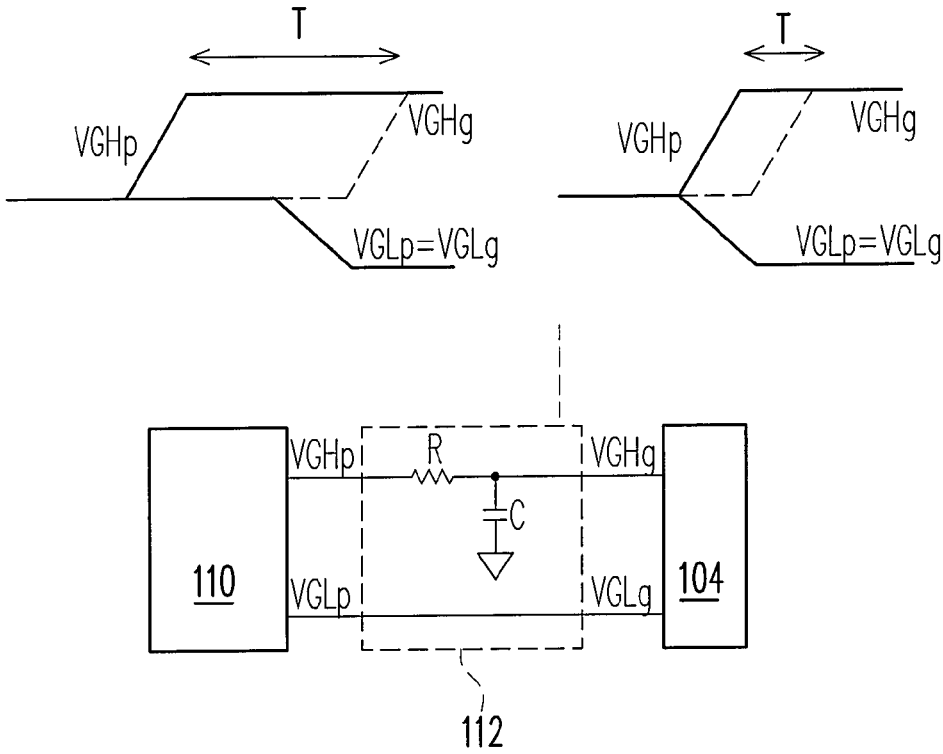
FIG. 2 (PRIOR ART)
FIG. 2 is a schematic diagram illustrating a conventional mechanism for changing the sequence of providing power sources.

The present invention changes a sequence of providing voltage sources, by triggering with a threshold voltage of a MOS transistor, in accordance with the fabrication of the IC. Particularly, the present invention does not require the use of a resistor and a capacitor as conventional does, and therefore the circuit of the present invention can be directly integrated into the IC of a gate driver. In other words, the present invention is adapted to vary the sequence of providing the voltage sources without employing a resistor, a capacitor or a control signal which are conventionally required.

The present invention utilizes a current limit MOS resistor which is originally employed inside the gate driver so as to change an input sequence of a VGH signal and a VGL signal by triggering the MOS element. As such, when the VGH and VGL voltage signals provided by a power block is going to enter in the gate driver, they can be maintained by the circuit configuration of the present invention to enter the gate driver only when the VGH and VGL signals reach a particular voltage value, so as to avoid the damage caused to the circuit.

According to the present invention, the aforementioned mechanism can be achieved by well designing the size ratio of the MOS elements. Meanwhile, the application range of the VGH and VGL voltages can also be determined. Therefore, the present invention can be applied without any external element or any external signal. As such, the present invention can be integrated in the IC of the gate driver, while does not seriously affect the chip area. As to the LCD system, cost for external elements can be saved.

Reference will now be made in detail to the present preferred embodiments of the invention, examples of which are illustrated in the accompanying drawings. Wherever possible, the same reference counting numbers are used in the drawings and the description to refer to the same or like parts.

Figure 3:
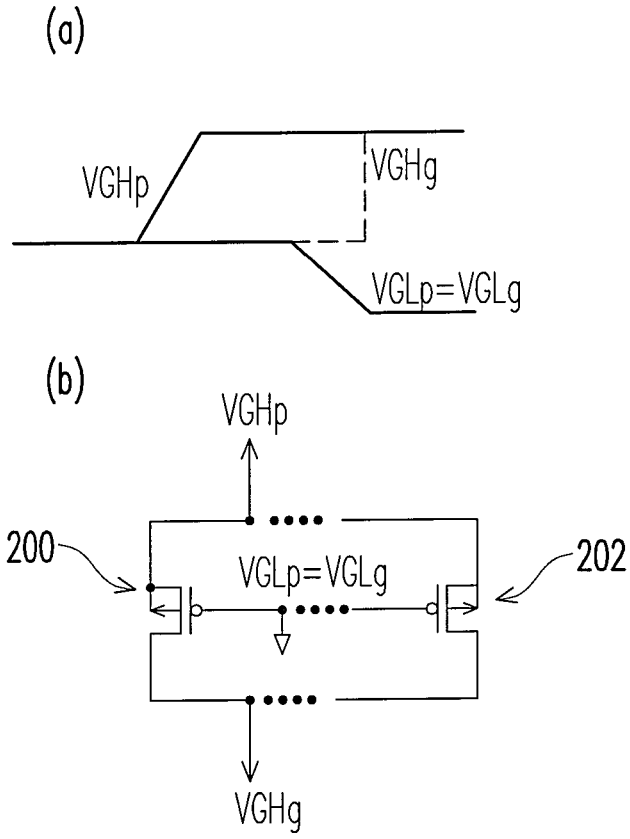
FIG. 3 illustrates a power control mechanism according to an embodiment of the present invention.

FIG. 3 illustrates a power control mechanism according to an embodiment of the present invention. Referring to FIG. 3(*a*), according to the power control mechanism of the present invention, only when a negative voltage signal VGLp is smaller than a threshold, a VGHp provided by a power block is outputted to an inner circuit of a gate driver. Further the present invention utilizes a current limit circuit, which is originally embedded inside the gate driver, as a power control circuit. Therefore, before illustrating the power control circuit of the present invention, the current limit circuit is described in advance below. Referring to FIG. 3(*b*), it illustrates the basic mechanism of the current limit circuit. In this embodiment, the current limit circuit is designed with the characteristic of a PMOS transistor as a resistor, so that a PMOS transistor 200 is disposed on a path between the VGHp and the VGHg. Further, the present invention can also adopt a plurality of parallel paths. As shown in FIG. 3(*b*), in addition to the PMOS transistor 200, there is a PMOS transistor 202 which is same with the PMOS transistor 200 disposed on the path, too. VGHp is an inputted positive voltage signal, and VGHg is a positive voltage signal which is inputted in the gate driver. VGLp is an inputted negative voltage signal, and is identical with VGLg which is a negative voltage signal to be inputted in the gate driver, and both of which are coupled to the gate of the PMOS transistor 200.

The current limit circuit of FIG. 3(*b*) is adapted for the following current limiting performance. The gate driver typically requires a current limit circuit, for limiting currents between the external voltage VGHp and the inner voltage VGHg. Before turning off the LCD system, all output channels G1 through Gn of the gate driver should be pulled up to a voltage level of VGHg, so as for turning on all TFTs of all pixels, for discharging charges stored in the capacitors Cs and the liquid crystal capacitors Clc of the pixels, in order to avoid occurrence of image blur when the LCD system is turned on again. As such, when the system is turned off, there must be provided a current limit mechanism, for avoiding the occurrence of a large transient current during the discharging process which may damage the circuit. The current limit MOS resistors 200 and 202 are employed for achieving the foregoing current limiting mechanism, and for avoiding the occurrence of the large transient current. According to an embodiment of the present invention, the MOS resistors 200 and 202 are preferably designed with a large W/L ratio, for guaranteeing the normal operation of the current limiting mechanism.

Figure 4:
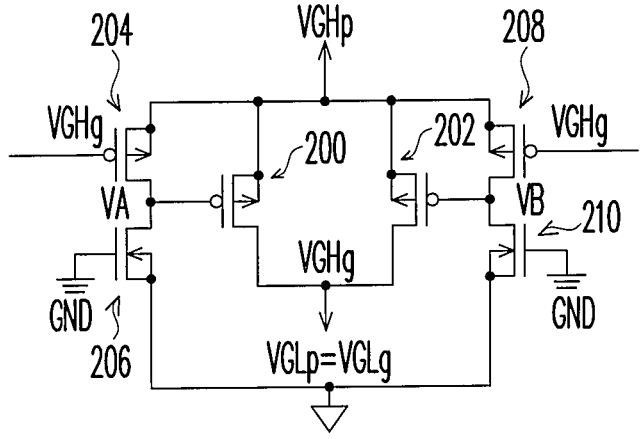
FIG. 4 is a schematic diagram illustrating a power sequence control circuit according to an embodiment of the present invention.

According to the circuit mechanism of FIG. 3, the present invention provides a power sequence control circuit. FIG. 4 is a schematic diagram illustrating a power sequence control circuit according to an embodiment of the present invention. Referring to FIG. 3 according to the mechanism of FIG. 3 and incorporating the entirety of the gate driving, the present invention is adapted to control the sequence of providing the power. The current embodiment is exemplified with two parallel connected identical paths for illustration. However, the basic performance of the present invention can be achieved with only one path. The PMOS resistors 200, 202 are as shown in FIG. 3. Gates of the PMOS transistors 200, 202 are coupled to control terminals having control voltages VA and VB, respectively. Further, a PMOS transistor 204, serving as a resistor, is coupled between a first terminal having the input voltage VGHp and the control terminal having the voltage VA. Similarly, a further PMOS transistor 208, serving as a resistor, is coupled between the first terminal having the input voltage VGHp and the control terminal having the voltage VB. The gates of the PMOS transistors 204, 208 are coupled to the output voltage VGHg for provide feedbacks. An NMOS transistor 206, serving as a resistor, is coupled between the terminal having the voltage VA and the terminal having the voltage VGLp. A gate of the NMOS transistor 206 is coupled to a system low voltage VCC, e.g., a ground voltage GND. An NMOS transistor 210, serving as a resistor, is coupled between the terminal having the voltage VB and the terminal having the voltage VGLp. A gate of the NMOS transistor 210 is coupled to a system low voltage VCC, e.g., a ground voltage GND.

An operation mechanism of the power sequence control circuit is as follows. If VGHp enters the gate driving circuit earlier than VGLp=VGLg=0V, or enters at the same time with VGLp, because a default value of VGHg is 0V, PMOS transistors 204 and 208 conduct, so that VA=VB=VGHp. The PMOS transistors 200 and 202 are not conducted, so that the inner VGHg is 0V.

When VGLp=VGLg=VGL drop to a particular voltage value, the NMOS transistors 206 and 210 conduct, thus pulling up the voltages VA and VB to a level of VGL, so that the PMOS transistors 200 and 202 are conducted. In this time, the inner positive voltage VGHg reaches the level of VGHp, and enters later than VGLg. In a stable state, the PMOS transistors 204 and 206 are at an OFF status, for avoiding constructing a direct current path, e.g., VGHp→PMOS transistors 204 and 208→NMOS transistors 206 and 210→VGL which consumes power. As such, despite the sequence of the external power sources, the embodiment of the present invention can assure that the VGLg enters the gate river circuit earlier than the VGHg by the PMOS transistors 204, 208, and NMOS transistors 206, 210, and can prevent the occurrence of latch-up problems from occurrence.

In designing according to the present invention, it needs to make sure that in all of the voltage application range, driving abilities of the NMOS transistors 206, 210 are greater than that of the PMOS transistors 204, 208. These four MOS transistors can decrease the transient current without requiring much area and occupying usable area. The VGHg is an inner voltage source of the gate driver. As such, when turning off, the VGHg is promptly discharged, and therefore there won't be a problem of slow discharging because of an external stabilizing capacitor of the conventional technology.

The structure of the foregoing embodiment of the present invention can be directly integrated into a gate driver circuit to reduce the element cost without occupying too much chip area. Similarly, in a stable state, such a gate driver circuit dose not have the problem of a DC short current. Further, the present invention is adapted for a wide application range, in which it is only required to make sure that the driving abilities of the NMOS transistors 206, 210 are greater than that of the PMOS transistors 204, 208 in designing. According to a laboratory testing result the voltage application range can be VGHp=5V to 25V, and VGLp=−5V to −20V. Further, when the power is turning off, VGHg will be discharged promptly, and therefore there won't be a problem of slow discharging caused by the prior art external stabilizing capacitor. Furthermore, the gate driver circuit according to the embodiment of the present invention can change the sequence of providing the powers without employing any other control signal, e.g., control signals provided by a timing controller 100.

Figure 5:
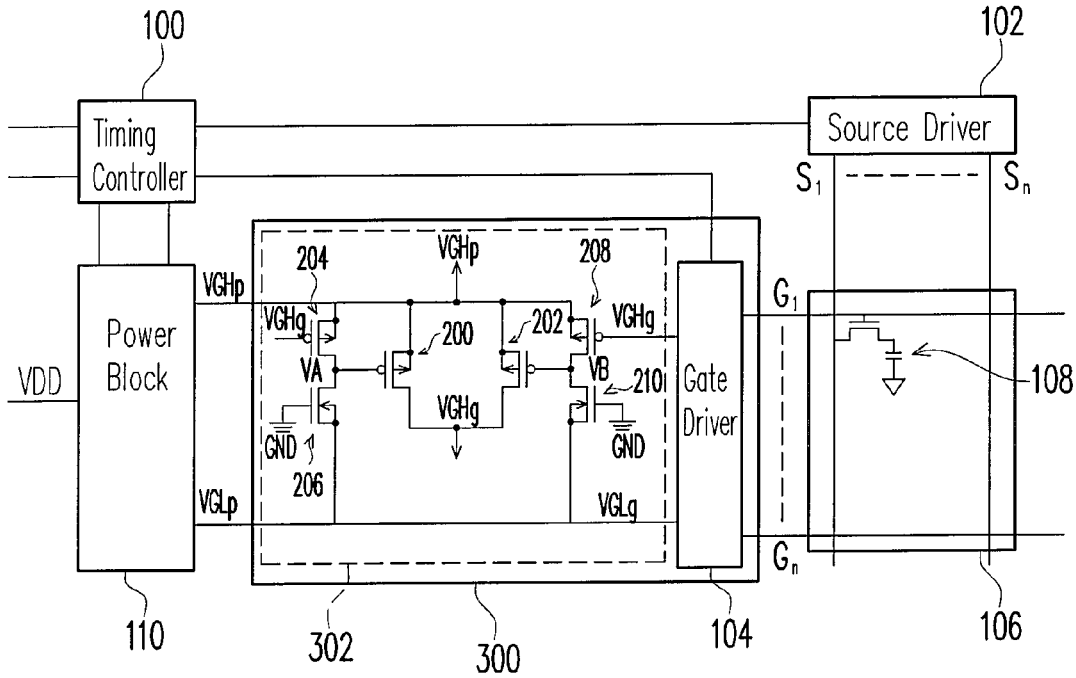
FIG. 5 is a schematic diagram illustrating a structure of an LCD panel according to an embodiment of the present invention.

FIG. 5 is a schematic diagram illustrating a structure of an LCD panel according to an embodiment of the present invention. Referring to FIG. 5, the circuit 302 of FIG. 4 can be integrated with an ordinary gate driver 104 to configure a gate driver 300. The gate driver 300 can be applied in an LCD panel for improving the performance of the LCD panel.

Figure 6:
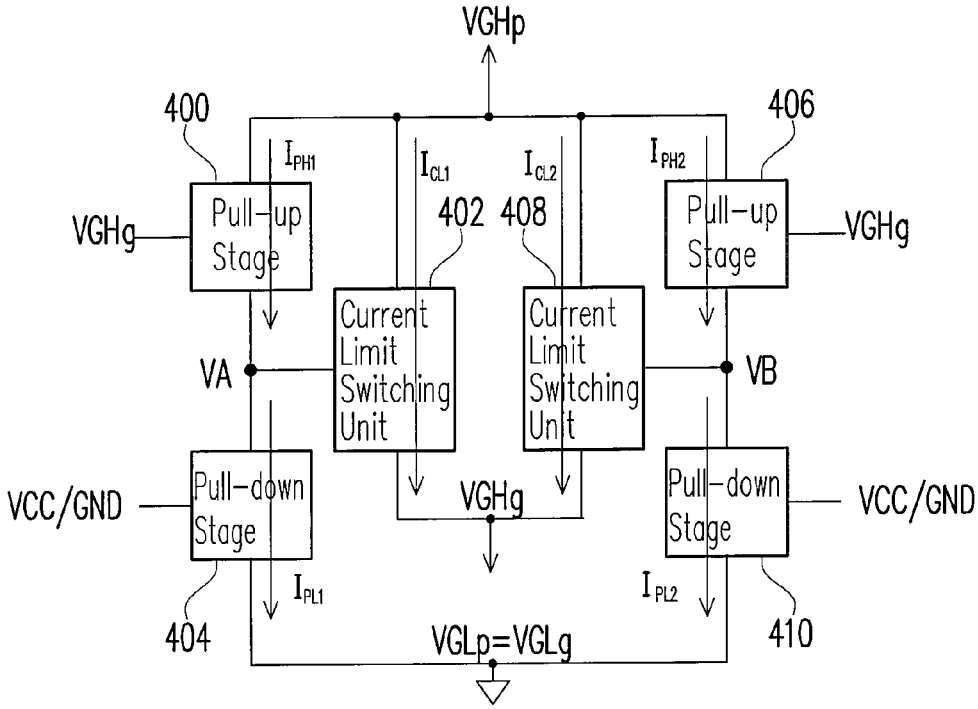
FIG. 6 is a schematic diagram illustrating a power sequence control circuit according to an embodiment of the present invention.

FIG. 6 is a schematic diagram illustrating a power sequence control circuit according to an embodiment of the present invention. Referring to FIG. 6, according to the circuit of FIG. 4, the power sequence control circuit according to the present invention receives an input positive voltage VGHp and an input negative voltage VGLp, for providing an output positive voltage VGHg and an output negative voltage VGLg to a gate driver. The power sequence control circuit includes a voltage pull-up stage 400, 406, having a first terminal receiving the input positive voltage VGHp, an output terminal outputting a control voltage VA, VB, and a control terminal receiving a feedback of the output positive voltage VGHg. The power sequence control circuit further includes a voltage pull-down stage 404, 410, having a first terminal receiving the control voltage VA, VB outputted from the voltage pull-up stage 400, 406, and an output terminal coupled to an output negative voltage VGLp=VGLg. The power sequence control circuit further includes a current limit switching unit 402, 408 having a first terminal receiving the input positive voltage, an output terminal outputting the output positive voltage VGHg, and a control terminal receiving the control signal outputted from the power pull-up stage 400, 406. When the output negative voltage VGLg of the voltage pull-down stage 404, 410 drops toward the input negative voltage VGLp, it also pulls down the control voltage VA, VB outputted from the voltage pull-up stage 400, 406. When the control voltage VA, VB is pulled down to a threshold value, the current limit switching unit 402, 408 conducts to transmit the input positive voltage VGHp as the output positive voltage VGHg.

Figure 7:
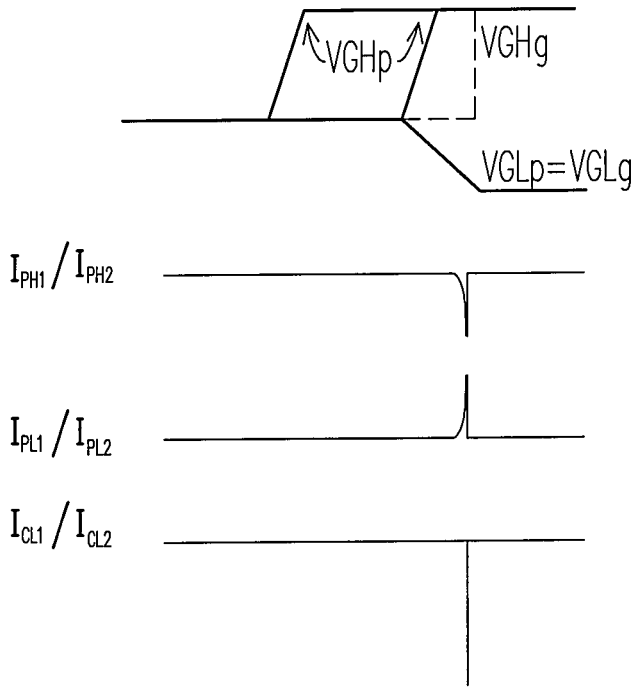
FIG. 7 illustrates variation of current signals according to an embodiment of the present invention.

With respect to the operation mechanism, in one path there are three foregoing blocks 400, 402, 404. When VGHp increases earlier than when VGLp decreases, VA/VB will be pulled up to VGHp, during which the current limit unit 402 is at an OFF status (not conducted), and VGHg=0V, when VGLp=VGLg=VGL drops to a particular voltage level, the power pull-up stage 400 and the power pull-down stage 404 are turned on, in which IPL1>IPH1, and IPL2>IPH2 (i.e. see FIG. 7). In a stable state, VA/VB will be pulled down to VGLp, and meanwhile the current limit switching unit 402 is at an ON status (conducted), and VGHg=VGHp. FIG. 7 illustrates variation of current signals according to an embodiment of the present invention. Referring to FIG. 7, it can be learnt from the variation of the current signals of the three blocks 400, 402, 404 that VGHg can enter later than VGLg.

Figure 8:
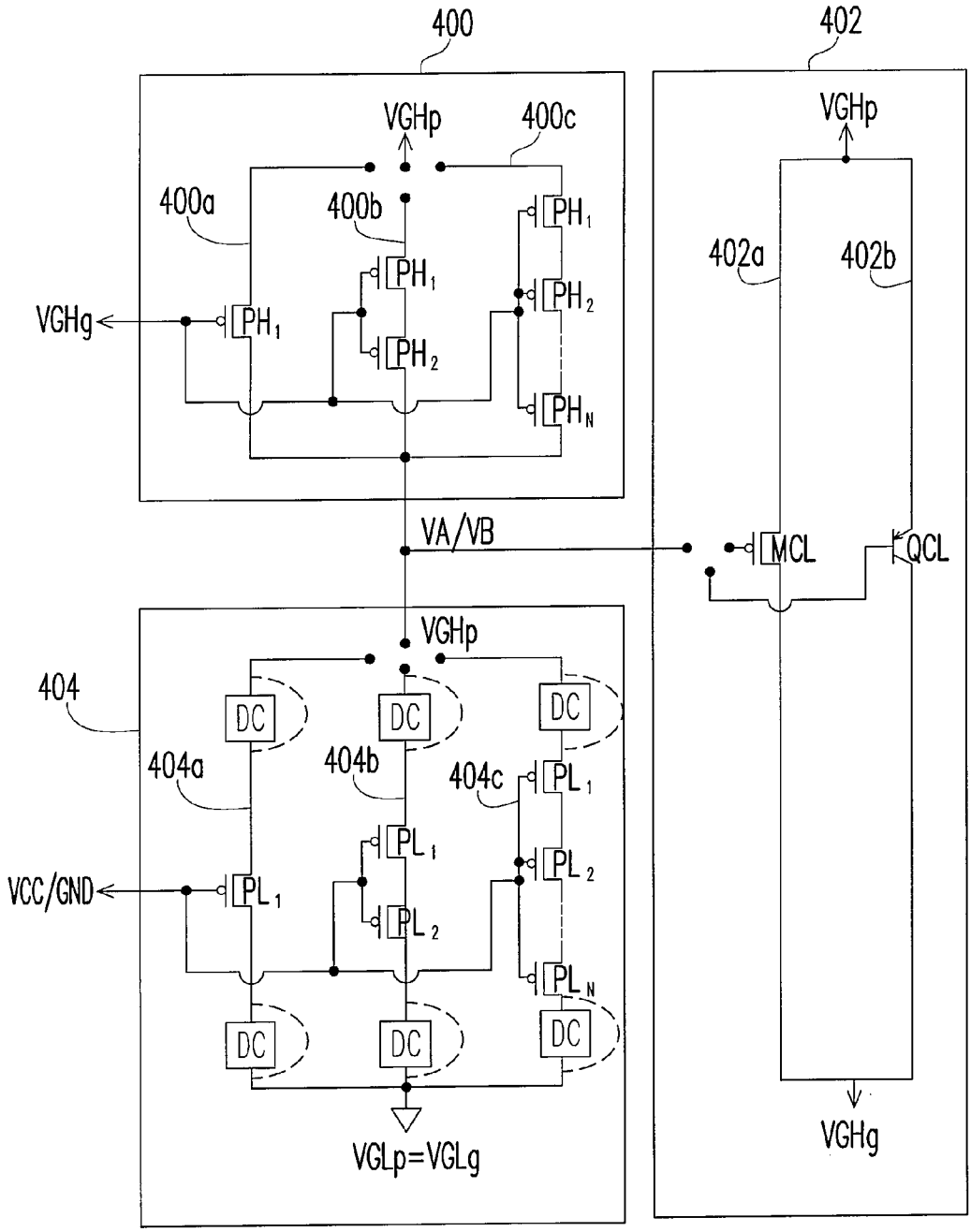
FIG. 8 is a schematic diagram illustrating a design of the power sequence control circuit according to an embodiment of the present invention.

FIG. 8 is a schematic diagram illustrating a design of the power sequence control circuit according to an embodiment of the present invention. Referring to FIG. 8, quantities of the MOS transistor used by the voltage pull-up stage 400, the voltage pull-down stage, and the current limit switching unit 402 are not to be limited, and can be adaptively designed with a multiple of combinations. Open nodes in the drawing indicate where need multiple choices.

Taking the voltage pull-up stage 400 as an example, it can use only one PMOS ($PH_1$), or two serially coupled PMOS ($PH_1$, $PH_2$), or even N PMOS ($PH_1$, $PH_2$, . . . , $PH_{N-1}$, $PH_N$). Also, it is preferred to use two parallel coupled paths as shown in FIG. 4, while the quantity of the paths 400*a*, 400*b*, 400*c* can also be modified as desired in practice.

Figure 9:
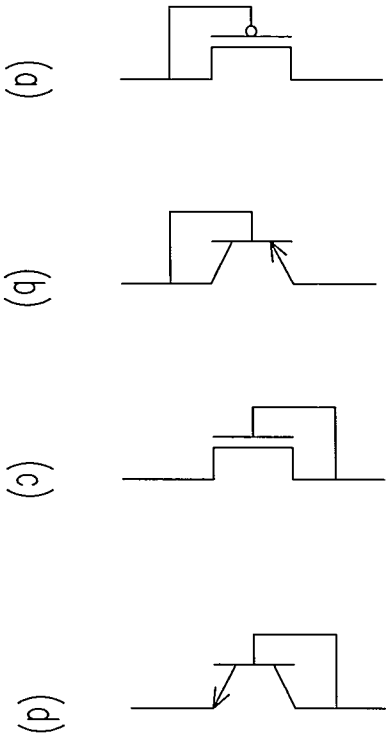
FIG. 9 shows several connections of a diode according to an embodiment of the present invention.

Further, taking the voltage pull-down stage 404 as an example, it can use only one NMOS ($NH_1$), or two serially coupled NMOS ($NH_1$, $NH_2$), or even N NMOS ($NH_1$, $NH_2$, . . . , $NH_{N-1}$, $NH_N$). Also, it is preferred to use two parallel coupled paths as shown in FIG. 4, while the quantity of the paths 404*a*, 404*b*, 404*c* can also be modified as desired in practice. Further, in accordance with different voltage application ranges, a diode connection (DC) can be employed in addition, as shown in FIG. 9. FIG. 9 shows several connections of a diode according to an embodiment of the present invention. In the voltage pull-down stage 404, the DC block can be one or more BJT transistors, e.g., PNP or NPN, or MOS elements, e.g., PMOS or NMOS, presented as DC, or otherwise a combination of BJT and MOS elements.

With respect to current limit switching unit 402, it for example can be achieved with PMOS (MCL) or a PNP BJT (QCL), as shown by paths 402*a*, 402*b*.

The present invention integrates the power sequence control circuit and the gate driver, for change the sequence of providing power.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A power sequence control circuit, receiving an input positive voltage and an input negative voltage, for providing an output positive voltage and an output negative voltage to a driver, comprising:

a voltage pull-up stage, having a first terminal coupled to the input positive voltage, a second terminal coupled to a node, and a control terminal receiving a feedback of the output positive voltage;

a voltage pull-down stage, having a first terminal coupled to the node, and a second terminal coupled to the output negative voltage; and a current limit switching unit, having a first terminal receiving the input positive voltage, a second terminal outputting the output positive voltage, and a control terminal coupled to the node, wherein the second terminal is only coupled to the control terminal of the voltage pull-up stage and an external device that receives the output positive voltage, wherein when the output negative voltage decreases, the voltage pull-down stage pulls down a control voltage at the node, and when the control voltage is lower than an enabling threshold, the current limit switching unit conducts immediately upon the output negative voltage decreasing to a level and causing the control voltage lower than the enabling threshold, thus to transmit the input positive voltage as the output positive voltage being identical to the input positive voltage, wherein before the current limit switching unit is conducted, the output positive voltage remains at an initial voltage level, wherein the input negative voltage and the input positive voltage are at voltage levels varying in input time sequence but not at fixed voltage levels.

2. The power sequence control circuit according to claim 1, wherein the voltage pull-down stage comprises a resistor coupled between the first terminal and the second terminal of the voltage pull-down stage.

3. The power sequence control circuit according to claim 1, wherein the voltage pull-up stage comprises a first path comprising at least one PMOS transistor serially coupled between the first terminal and the second terminal of the voltage pull-up stage, and a gate of the PMOS transistor is coupled to the control terminal of the voltage pull-up stage.

4. The power sequence control circuit according to claim 3, wherein the voltage pull-up stage further comprises a second path having a same configuration of the first path and being parallel coupled with the first path.

5. The power sequence control circuit according to claim 1, wherein the voltage pull-down stage comprises a first path comprising at least one NMOS transistor, serially coupled between the first terminal and the second terminal of the voltage pull-down stage, and a gate of the NMOS transistor is coupled to a system low voltage.

6. The power sequence control circuit according to claim 5, wherein the voltage pull-down stage further comprises a second path having a same configuration of the first path and being parallel coupled with the first path.

7. The power sequence control circuit according to claim 5, wherein the first path of the voltage pull-down stage further comprises at least one diode serially coupled to the NMOS transistor.

8. The power sequence control circuit according to claim 1, wherein the current limit switching unit comprises a first path comprising at least one PMOS transistor, serially coupled between the first terminal and the second terminal of the current limit switching unit, and a gate of the PMOS transistor is coupled to the control terminal of the current limit switching unit.

9. The power sequence control circuit according to claim 8, wherein the current limit switching unit further comprises a second path having a same configuration of the first path and parallel coupled with the first path.

10. The power sequence control circuit according to claim 1, wherein the current limit switching unit comprises a first path comprising at least one BJT (bipolar junction transistor), serially coupled between the first terminal and the second terminal of the current limit switching unit, and a base electrode of the BJT is coupled to the control terminal of the current limit switching unit.

11. The power sequence control circuit according to claim 10, wherein the current limit switching unit further comprises a second path having a same configuration of the first path and parallel coupled with the first path.

12. A gate driver, for driving an LCD panel, the gate driver comprising:

a gate driving circuit, for driving the LCD panel; and a power sequence control circuit, receiving an input positive voltage and an input negative voltage, for providing an output positive voltage and an output negative voltage to a driver, the power sequence control circuit comprising:

a voltage pull-up stage, having a first terminal coupled to the input positive voltage, a second terminal coupled to a node, and a control terminal receiving a feedback of the output positive voltage;

a voltage pull-down stage, having a first terminal coupled to the node, and a second terminal coupled to the output negative voltage; and a current limit switching unit, having a first terminal receiving the input positive voltage, a second terminal outputting the output positive voltage, and a control terminal coupled to the node, wherein the second terminal is only coupled to the control terminal of the voltage pull-up stage and an external device that receives the output positive voltage, wherein when the output negative voltage decreases, the voltage pull-down stage pulls down a control at the node, and when the control voltage is lower than an enabling threshold, the current limit switching unit conducts immediately upon the output negative voltage decreasing to a level and causing the control voltage lower than the enabling threshold, thus to transmit the input positive voltage as the output positive voltage being identical to the input positive voltage, wherein before the current limit switching unit is conducted, the output positive voltage remains at an initial voltage level, wherein the input negative voltage and the input positive voltage are at voltage levels varying in input time sequence but not at fixed voltage levels.

13. The gate driver according to claim 12, wherein the power sequence control circuit and the gate driving circuit are integrated in a gate driving chip.

14. The gate driver according to claim 12, wherein the voltage pull-down stage comprises a resistor coupled between the first terminal and the second terminal of the voltage pull-down stage.

15. The gate driver according to claim 12, wherein the voltage pull-up stage comprises a first path comprising at least one PMOS transistor serially coupled between the first terminal and the second terminal of the voltage pull-up stage, and a gate of the PMOS transistor is coupled to the control terminal of the voltage pull-up stage.

16. The gate driver according to claim 15, wherein the voltage pull-up stage further comprises a second path having a same configuration of the first path and being parallel coupled with the first path.

17. The gate driver according to claim 12, wherein the voltage pull-down stage comprises a first path comprising at least one NMOS transistor, serially coupled between the first terminal and the second terminal of the voltage pull-down stage, and a gate of the NMOS transistor is coupled to a system low voltage.

18. The gate driver according to claim 17, wherein the voltage pull-down stage further comprises a second path having a same configuration of the first path and being parallel coupled with the first path.

19. The gate driver according to claim 17, wherein the first path of the voltage pull-down stage further comprises at least one diode serially coupled to the NMOS transistor.

20. The gate driver according to claim 12, wherein the current limit switching unit comprises a first path comprising at least one PMOS transistor, serially coupled between the first terminal and the second terminal of the current limit switching unit, and a gate of the PMOS transistor is coupled to the control terminal of the current limit switching unit.

21. The gate driver according to claim 20, wherein the current limit switching unit further comprises a second path having a same configuration of the first path and parallel coupled with the first path.

22. The gate driver according to claim 12, wherein the current limit switching unit comprises a first path comprising at least one BJT (bipolar junction transistor), serially coupled between the first terminal and the second terminal of the current limit switching unit, and a base electrode of the BJT is coupled to the control terminal of the current limit switching unit.

23. The gate driver according to claim 22, wherein the current limit switching unit further comprises a second path having a same configuration of the first path and parallel coupled with the first path.

24. An LCD device, comprising:

a pixel display unit, having a plurality of pixels; a source driver; a gate driver, wherein the source driver and the gate driver drive the pixels for displaying;

a power unit, providing an operation positive voltage and an operation negative voltage;

a power sequence control circuit, receiving an input positive voltage and an input negative voltage, for providing an output positive voltage and an output negative voltage to a driver, comprising:

a voltage pull-up stage, having a first terminal coupled to the input positive voltage, a second terminal coupled to a node, and a control terminal receiving a feedback of the output positive voltage;

a voltage pull-down stage, having a first terminal coupled to the node, and a second terminal coupled to the output negative voltage; and a current limit switching unit, having a first terminal receiving the input positive voltage, a second terminal outputting the output positive voltage, and a control terminal coupled to the node, wherein the second terminal is only coupled to the control terminal of the voltage pull-up stage and an external device that receives the output positive voltage; and a timing controller controlling the source driver, the gate driver, the power unit, and the power sequence control circuit, for indirectly driving the pixel display unit, wherein when the output negative voltage decreases, the voltage pull-down stage pulls down a control voltage at the node, and when the control voltage is lower than an enabling threshold, the current limit switching unit conducts immediately upon the output negative voltage decreasing to a level and causing the control voltage lower than the enabling threshold, thus to transmit the input positive voltage as the output positive voltage being identical to the input positive voltage, wherein before the current limit switching unit is conducted, the output positive voltage remains at an initial voltage level, wherein the input negative voltage and the input positive voltage are at voltage levels varying in input time sequence but not at fixed voltage levels.

25. The LCD device according to claim 24, wherein the power sequence control circuit and the gate driving circuit are independently disposed or integrated in a gate driving chip.

26. The LCD device according to claim 24, wherein the voltage pull-down stage is a resistor coupled between the first terminal and the second terminal of the voltage pull-down stage.

27. The LCD device according to claim 24, wherein the voltage pull-up stage comprises at least one path comprising at least one PMOS transistor serially coupled between the first terminal and the second terminal of the voltage pull-up stage, and a gate of the PMOS transistor is coupled to the control terminal of the voltage pull-up stage.

28. The LCD device according to claim 24, wherein the voltage pull-down stage comprises at least one path comprising at least one NMOS transistor, serially coupled between the first terminal and the second terminal of the voltage pull-down stage, and a gate of the NMOS transistor is coupled to a system low voltage.

29. The LCD device according to claim 24, wherein the current limit switching unit comprises a first path comprising at least one PMOS transistor, serially coupled between the first terminal and the second terminal of the current limit switching unit, and a gate of the PMOS transistor is coupled to the control terminal of the current limit switching unit.

30. The LCD device according to claim 24, wherein the current limit switching unit comprises at least one path comprising at least one BJT (bipolar junction transistor), serially coupled between the first terminal and the second terminal of the current limit switching unit, and a base electrode of the BJT is coupled to the control terminal of the current limit switching unit.

* * * * *